United States Patent [19]

Renders et al.

[11] 4,078,301

[45] Mar. 14, 1978

[54] METHOD OF MANUFACTURING A DEFLECTION COIL FOR A CATHODE RAY TUBE

[75] Inventors: Martinus Andrianus Renders; Wolter Wilhelmus Johannes Degger, both of Eindhoven, Netherlands

[73] Assignee: U.S. Philips Corporation, New York, N.Y.

[21] Appl. No.: 631,735

[22] Filed: Nov. 13, 1975

[30] Foreign Application Priority Data

Nov. 27, 1974 Netherlands ..... 7415441

[51] Int. Cl.[2] ..... H01F 41/04

[52] U.S. Cl. ..... 29/605; 335/213

[58] Field of Search ..... 29/605; 335/213; 336/200

[56] References Cited

U.S. PATENT DOCUMENTS

| | | | |
|---|---|---|---|
| 3,139,566 | 6/1964 | Marley | 335/213 X |
| 3,754,322 | 8/1973 | Chandler | 335/213 X |

*Primary Examiner*—Carl E. Hall

*Attorney, Agent, or Firm*—Frank R. Trifari; Henry I. Steckler

[57] ABSTRACT

A deflection coil consisting of a number of elementary coils formed by folding flat coils along four folding lines such that at the area of the folding lines each turn crosses all other turns. Very accurate deflection coils can thus be manufactured in a simple manner.

4 Claims, 19 Drawing Figures

METHOD OF MANUFACTURING A DEFLECTION COIL FOR A CATHODE RAY TUBE

Figure 1:
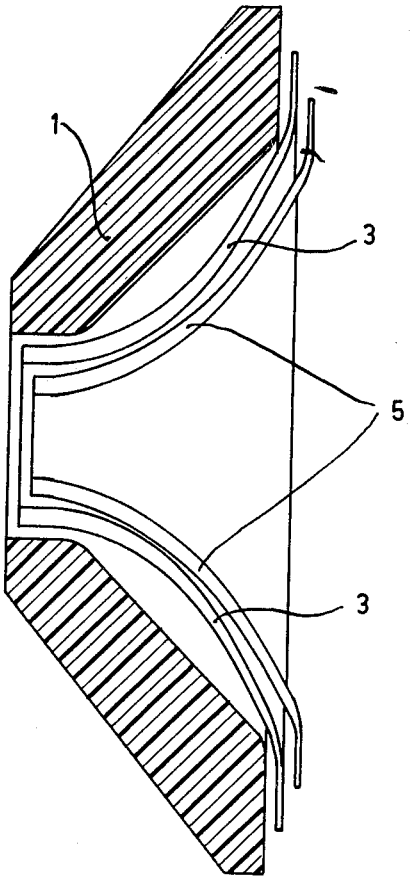

The invention relates to a deflection coil for a cathode-ray tube having a partly flared outer surface, consisting of at least one elementary coil which is formed by at least one conductor which extends about a window in a number of turns, and furthermore relates to a method of manufacturing such deflection coils.

Deflection coils commonly used for cathode-ray tubes thus far are usually saddle-shaped. They are wound to approximately the correct shape (adapted to the flared shape of the cathode-ray tube) in a jig, and are subsequently pressed. The accuracy of this method is insufficient for given applications, such as for colour television display tubes having large deflection angles. In accordance with U.S. Pat. No. 3,855,694 the accuracy can be improved by dividing the coil into sections and by accurately controlling the distribution of the turns between the various sections during winding. This method was found to offer satisfactory results, but is comparatively complex and requires expensive equipment. The invention has for its object to provide a deflection coil which can be comparatively simply but very accurately manufactured, and also a method of manufacturing such a coil. The deflection coil according to the invention is characterized in that the elementary coil is folded along four folding lines, intersecting the turns, such that each turn crosses all other turns in the vicinity of each folding line. The method of manufacturing such a coil according to the invention is characterized in that:

a. a flat coil is formed, consisting of a number of concentric conductor turns which extend in a flat plane, b. the flat coil is folded along four folding lines, intersecting the turns, such that portions of the plane of the turns situated on each side of each folding line are approximately at right angles to each other, c. the coil thus prefolded is pressed to obtain its ultimate shape in a suitable jig, the turns at the folding lines being folded further until the said portions of the plane of the turns enclose an angle of approximately 0°.

A flat coil having a simple shape can be readily wound with high accuracy. As a result of the folding and the further deformation, the coil according to the invention is thus obtained from a flat coil, whilst the accuracy is maintained.

In some cases it will be difficult to generate a given desired field distribution by means of a coil pair comprising elementary coils of one shape only. In accordance with an alternative according to the invention, each deflection coil of the pair can then be composed of at least two elementary coils of different shape.

The invention will be described in detail hereinafter with reference to the drawing.

FIG. 1 is a diagrammatic longitudinal sectional view of a deflection coil system comprising deflection coils according to the invention.

Figure 2A:
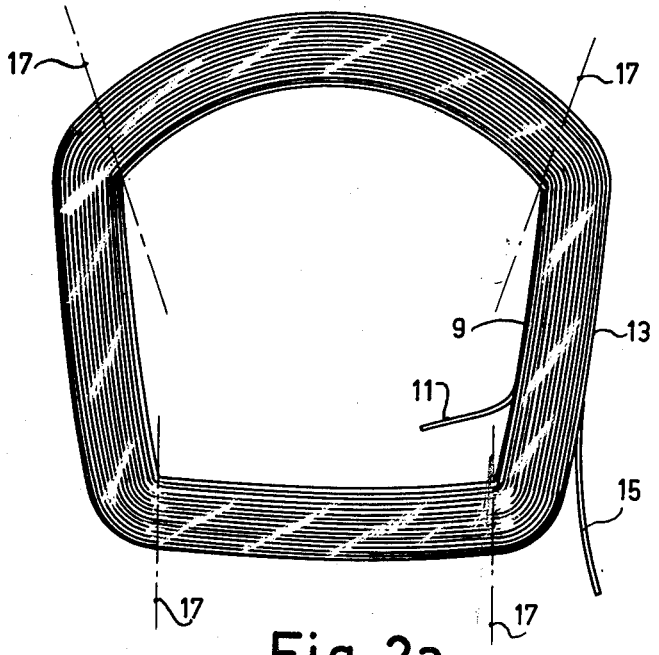

FIGS. 2*a* and *b* are plan views of a first embodiment of an elementary coil during two phases of its manufacture.

Figure 2B:
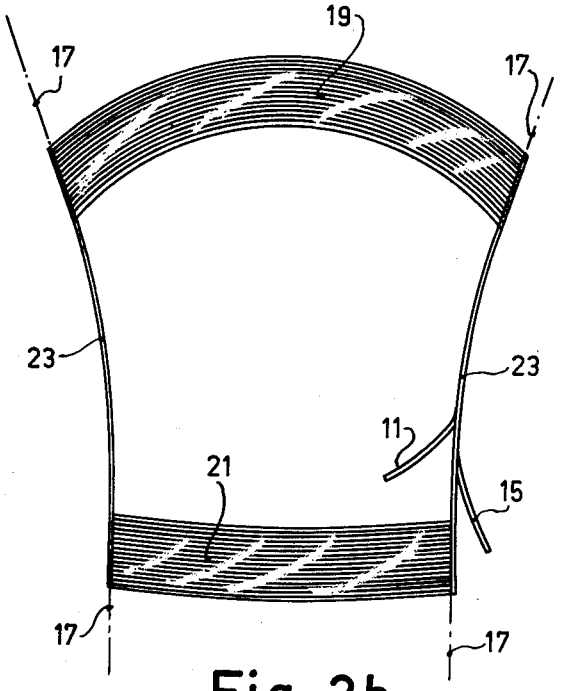
Figure 2C:
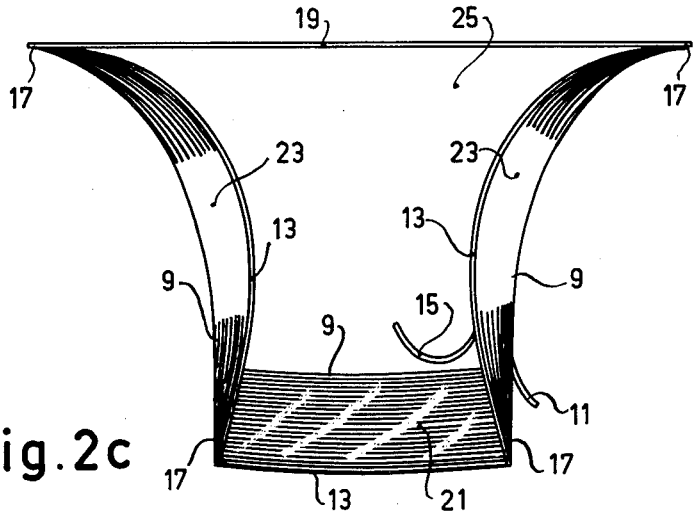
Figure 2D:
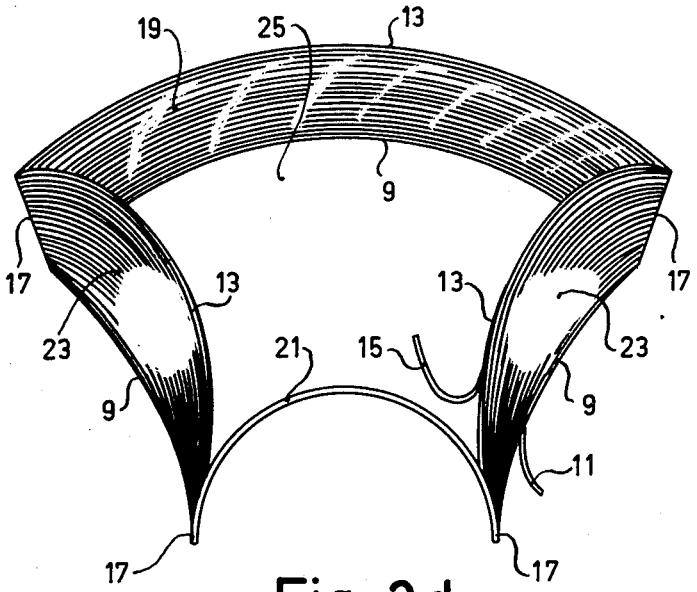
Figure 2E:
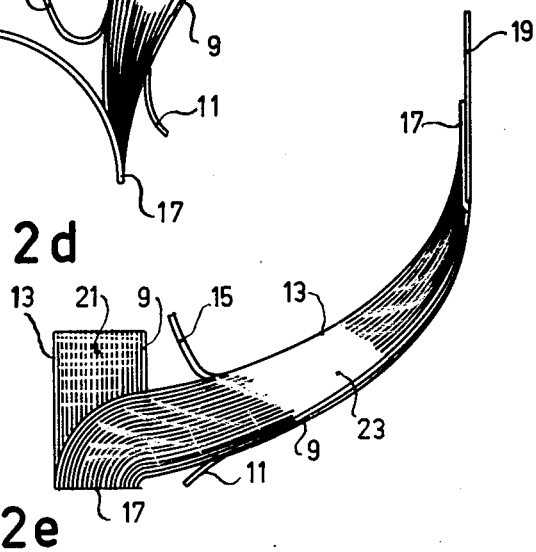
Figure 3A:
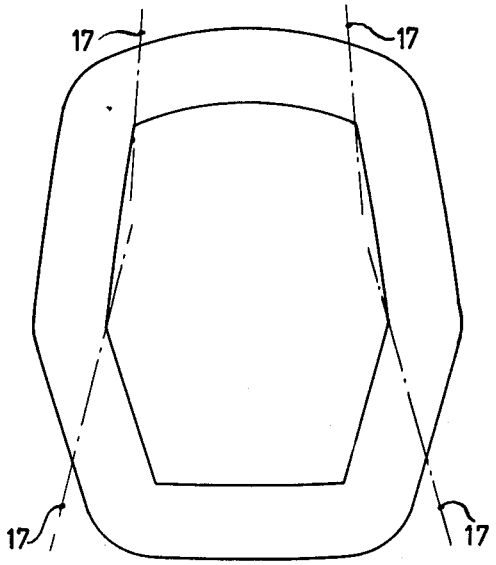
Figure 3B:
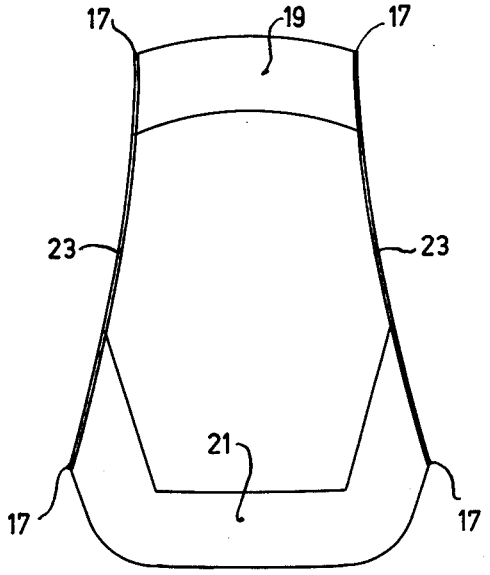
Figure 3C:
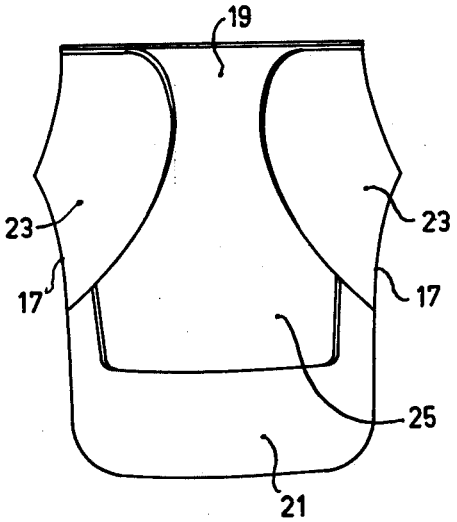
Figure 3D:
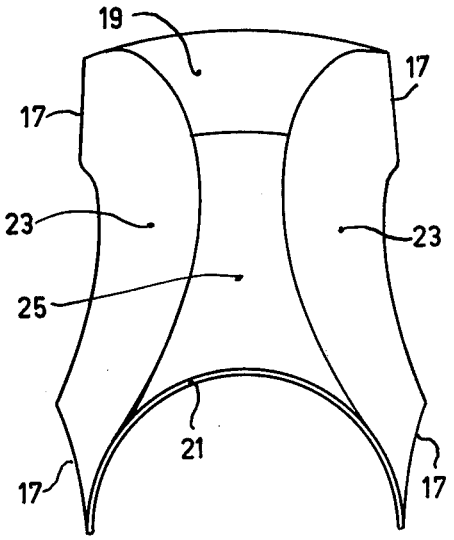
Figure 3E:
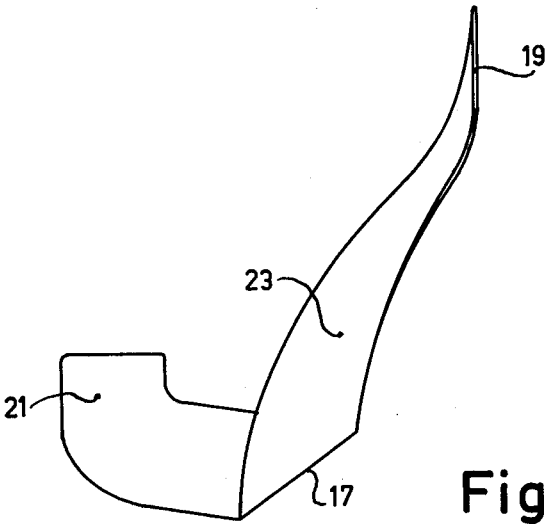
Figure 4A:
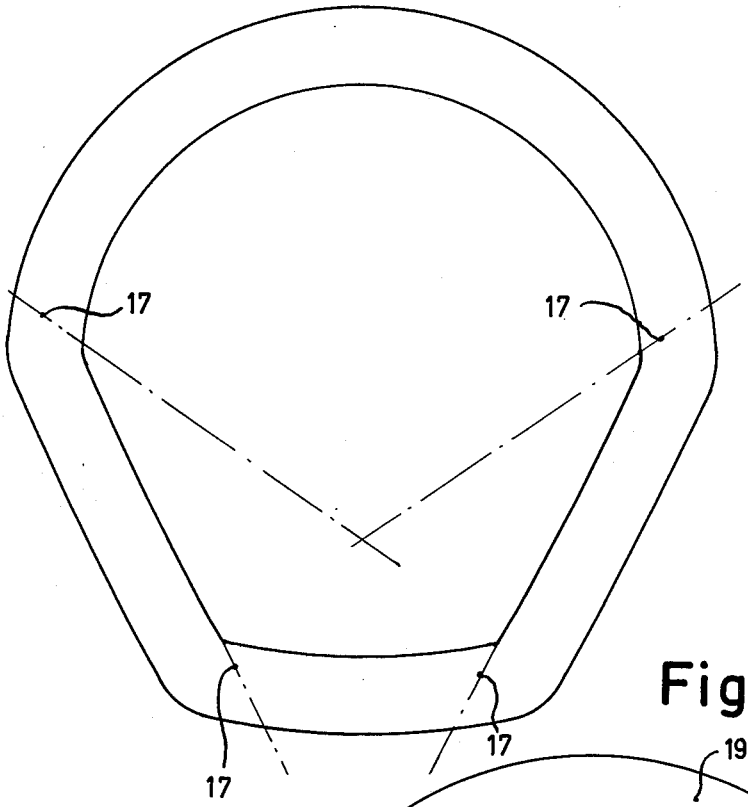
Figure 4B:
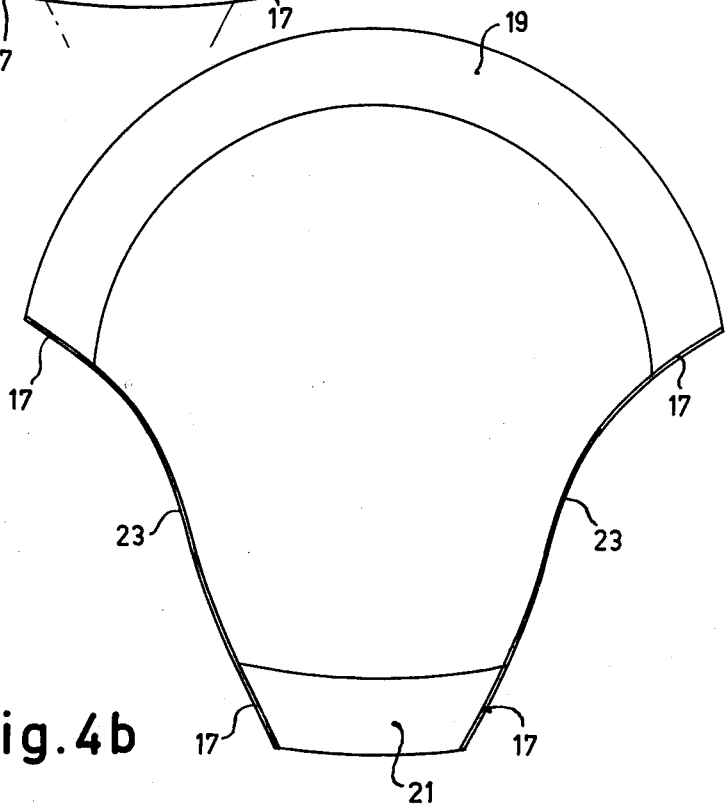
Figure 4C:
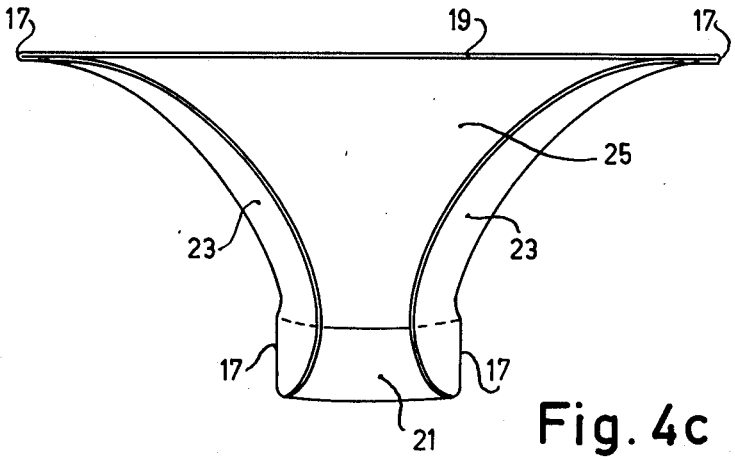
Figure 4D:
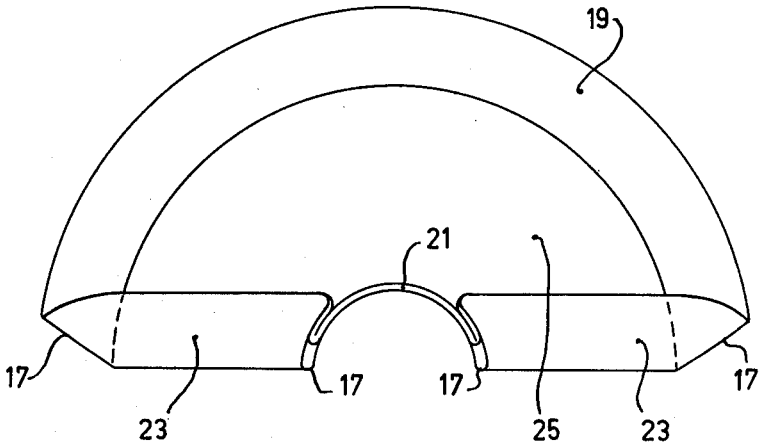
Figure 4E:
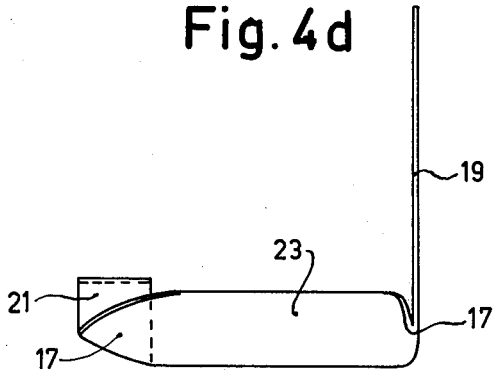

FIGS. 2*c* to *e* are a plan view, a rear view and a side elevation, respectively, of the same coil after completion.

FIGS. 3*a* to *e* are analogous to FIGS. 2*a* to *e*, and show a different embodiment of an elementary coil.

FIGS. 4*a* to *e* are also analogous to FIGS. 2*a* to *e*, and show a third embodiment.

Figure 5A:
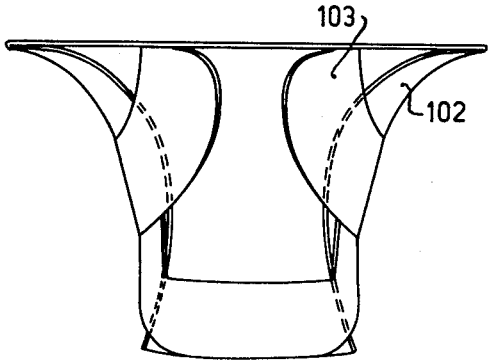
Figure 5B:
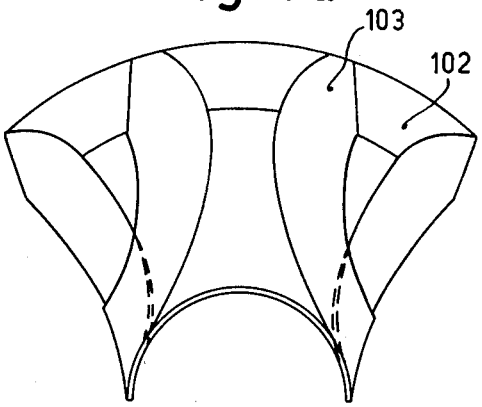
Figure 5C:
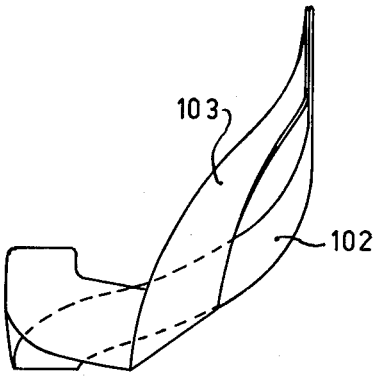

FIGS. 5*a* to *c* are a plan view, a rear view and a side elevation, respectively, of a deflection coil composed of the elementary coils shown in the FIGS. 2 and 3.

FIG. 1 shows a deflection coil system for a television display tube (not shown) having a partly flared outer surface. The deflection coil system comprises an annular ferromagnetic yoke 1, within which two frame deflection coils 3 are diametrically arranged, the said coils 3 enclosing two diametrically arranged line deflection coils 5. The construction of these deflection coils will be described with reference to the FIGS. 2 to 5.

FIG. 2*a* shows a flat coil obtained in a conventional manner by winding a conductor in a number of concentric turns about a coil former (not shown). The coil consists of 35 turns of insulated copper wire having a diameter of 0.5 mm. Aluminium wire can alternatively be used., for example. A further possibility consists in the winding of the coil using a wire having a rectangular cross-section, the wide side thereof being perpendicular to the plane of winding. This results in a coil having a very favourable fill rate. If desired, a plurality of wires can be simultaneously wound. A further possibility for the manufacture of the flat coil shown in FIG. 2 consists in the provision of conductor tracks in the desired pattern on a substrate, for example, a foil of synthetic material such as commonly used in the printed wiring technique. The coil has an inner turn 9 with a connection wire 11 and an outer turn 13 with a connection wire 15.

Subsequently, the flat coil is folded at approximately right angles along four folding lines 17, so that the portions of the plane of the turns on each side of each folding line are approximately at right angles to each other. The coil thus folded is shown in FIG. 2*b*. The foremost portion 19 and the rearmost portion 21 are still situated approximately in the plane of the drawing, whilst the two side portions 23 are approximately perpendicular to the plane of the drawing.

Finally, the prefolded coil is pressed to obtain its ultimate shape in a jig (not shown), the coil-preferably being heated as usual. During pressing the coil is shaped as shown in a plan view in FIG. 2*c*, in a rear view in FIG. 2*d*, and in a side elevation in FIG. 2*e*. These Figures clearly show that the portions of the plane of the turns which are situated on each side of each of the folding lines 17 enclose an angle of substantially 0°, so that the turns are arranged one over the other at these areas. The Figures also show that each turn crosses all other turns at the area of the folding lines 17. For example, the turn 13 which was situated completely on the outer side of the coil in FIG. 2*a*, is still situated on the outer side in the foremost and rearmost portions 19 and 21 (now forming coil heads), but crosses over to the inner side at the transitions between the coil heads and the active sides 23, so that in the side portions it extends along the window 25 enclosed by the coil. Conversely, the turn 9 extends on the inner side along the window 25 in the coil heads, like in FIG. 2*a*, and along the outer side in the side portions. It is clearly visible that all other turns extend similarly at the folding lines 17 with respect to the window 25, so that at these areas the turns cross each other.

The coil shown in the FIGS. 2*c* to *d* is an elementary coil which, when current is conducted therethrough, generates a magnetic field of a shape which is determined by the shape of the coil. FIGS. 3 and 4 show similar elementary coils of a slightly different shape which, consequently, produce other magnetic fields when current is conducted therethrough. For the sake of clarity, the same references have been used in all three Figures for corresponding parts of the coils. The indications of the individual turns and the connection wires have been omitted for the sake of simplicity. In some cases a deflection coil can consist of one elementary coil or a plurality of elementary coils of the same shape. The latter is the case if, for example, the conductor constituting the elementary coil is too thin for the desired deflection current. The use of thicker conductors may cause problems during the folding. Therefore, in such a case preferably a number of flat coils are stacked, after which they are prefolded and pressed into the ultimate shape together.

If it appears to be difficult to generate the desired deflection field by means of elementary coils of the same shape, a number of elementary coils of different shape can attractively be combined to form one deflection coil. This is shown in FIG. 5. The deflection coil shown therein consists of an elementary coil 102 as shown in FIG. 2, and an elementary coil 103 as shown in FIG. 3. Thus, a comparatively complex deflection coil is obtained which can still be manufactured in an accurately reproducible and inexpensive manner, because it is composed of simple elementary coils. This construction enables the manufacture of deflection coils of any desired field distribution by variation of the shape and the number of elementary coils. For example, for frame deflection in a 110° colour television display tube comprising three adjacently arranged electron guns, favourable results were obtained using deflection coils as shown in FIG. 5, be it that these coils consisted of two elementary coils 102 and one elementary coil 103. For the line deflection in the same tube, deflection coils consisting of two identical elementary coils as shown in FIG. 4 were found to offer excellent results. In general it may be stated that any desired deflection field can be generated by means of the deflection coils according to the invention.

We claim:

1. A method of manufacturing a deflection coil said method comprising a. forming a flat coil having a number of concentric conductor turns which extend in a flat plane, b. folding the flat coil along four folding lines intersecting the turns such that portions of the plane of the turns situated on each side of each folding line are approximately at right angles to each other, c. pressing the folded coil to obtain its ultimate shape in a suitable jig including further folding the turns at the folding lines until the said portions of the plane of the turns enclose an angle of approximately 0°.

2. A method as claimed in claim 1, further comprising stacking after the forming of the flat coil a number of flat coils of the same shape one on the other in a registering manner, the coil stack thus formed being subsequently subjected as one assembly to the folding and pressing processes.

3. A method as claimed in claim 1, further comprising combining a number of ultimately shaped elementary coils of different shape to form a deflection coil.

4. A method as claimed in claim 2 further comprising combining a number of ultimately shaped coil stacks of different shape to form a deflection coil.

* * * * *